US006634410B1

(12) United States Patent
Wilson et al.

(10) Patent No.: US 6,634,410 B1
(45) Date of Patent: Oct. 21, 2003

(54) MOLD APPARATUS AND METHOD

(76) Inventors: John H. Wilson, 200 Pensacola Beach Rd., No. E-3, Gulf Breeze, FL (US) 32561; Robert E. Wilson, 3311 Sugartree Ave., Pensacola, FL (US) 32503; John T. Wilson, 2355 Sugar Tree Ave., Pensacola, FL (US) 32503

( * ) Notice: Subject to any disclaimer, the term of this patent is extended or adjusted under 35 U.S.C. 154(b) by 45 days.

(21) Appl. No.: 09/941,054

(22) Filed: Aug. 28, 2001

(51) Int. Cl.[7] ..... B22C 9/24; B22C 7/02; B29C 33/40

(52) U.S. Cl. ..... 164/35; 164/45; 164/7.1; 164/160.1; 264/221; 264/227

(58) Field of Search ..... 164/45, 35, 516, 164/7.1, 7.2, 160.1, 160.2; 264/227, 221, 225, 226

(56) References Cited

U.S. PATENT DOCUMENTS

| | | | | |
|---|---|---|---|---|
| 4,027,723 A | * | 6/1977 | Maurino et al. | 164/213 |
| 4,617,977 A | * | 10/1986 | Mills | 164/30 |
| 5,176,867 A | * | 1/1993 | Thomas | 264/224 |
| 6,019,927 A | | 2/2000 | Galliger | 264/221 |

FOREIGN PATENT DOCUMENTS

| | | | |
|---|---|---|---|
| JP | 358053347 A | * | 3/1983 |
| JP | 362166049 A | * | 7/1987 |
| JP | 401224137 A | * | 9/1989 |
| JP | 404089154 A | * | 3/1992 |

* cited by examiner

*Primary Examiner*—M. Alexandra Elve
*Assistant Examiner*—Kevin McHenry
(74) *Attorney, Agent, or Firm*—J. Nevin Shaffer, Jr.

(57) ABSTRACT

A mold apparatus and method for creating designs on the interior of molds includes a resilient form with an exterior and an interior, with a design formed on the exterior. A rigid support member is removably attached to the interior of the resilient form. A mold pattern, conformed to removably receive the rigid support member and the resilient form in combination, completes the basic elements of the invention. In one aspect of the invention, a passageway in the rigid support member is provided for introducing a gas between the rigid support member and the resilient form. In another aspect of the invention, a vacuum application device is provided for applying a vacuum to the interior of the resilient form. The apparatus and method also provide for the simultaneous creation of designs on the interior and exterior of molds

25 Claims, 8 Drawing Sheets

MOLD APPARATUS AND METHOD

FIELD OF THE INVENTION

This invention relates to an improved mold apparatus and method. In particular, the invention relates to an apparatus and method for creating designs on the interior of molds. Even more particularly, the invention relates to an apparatus and method for creating investment cast molds with complex designs on the interior and/or on the interior and exterior of the molds.

BACKGROUND OF THE INVENTION

A tension arises when a business attempts to create objects with unique designs. The tension results from a conflict between various competing interests a business has. On one hand, businesses are interested in obtaining objects with unique designs that meet or exceed the customer's requirements. On the other hand, the business must keep time and cost to a minimum in order to remain profitable. If time and money are no object, almost any object may be created with any unique designs imagined. Since time and money are always a concern, however, there is a practical limitation to the creation of objects with unique designs that results in the practical impossibility of creating some objects and some designs in a commercially reasonable, i.e. profitable, manner.

By way of example and not limitation, it is known throughout the munitions industry that certain types of notch patterns or grooves cut into the inside, and outside, walls of a projectile or warhead case dramatically improves their fragmentation characteristics, thereby increasing overall effectiveness. Typically, such notches are cut utilizing traditional machining methods such as broaching, shaping, milling and sawing.

A major drawback to these traditional machining methods is their inherent low production rate and high cost. The cost of the cutting tools, machinery, and labor required to implement these traditional machining methods can easily create a situation in which it is cost prohibitive or unprofitable to produce such items on a mass production basis. As a result, even though a number of warheads/projectiles in existence or currently in production do employ notches, they are very simple or less than optimal notch patterns. That is, currently straight-line configurations i.e. straight up-and-down notches or circumferential rings, are the only practical configurations for machined/broached projectile cases. Furthermore, while designs on the outside of the casing are easier, the preferred casing has designs on the inside or on the inside and outside in combination, which is, again , extraordinarily difficult to accomplish.

The prior art machined or broached warhead/projectile cases perform only adequately, because the fragments have a tendency to slab (not separate) due to the straight-line broaching/notching configuration limitation. As a result, fragmentation and, consequently, lethality is only modestly controlled and predictable when cases are created with the limited machine options known in the prior art.

Attempts have been made to create complex shapes without machining. Galliger, U.S. Pat. No. 6,019,927 discloses the use of a flexible and resilient positive pattern to make solid parts with complex geometry. However, the flexible and resilient pattern is simply used to create a hard shell into which metal is poured. That is, the Galliger device can only be used to create a solid thing and can not be used to create a casing with an interior with a complex geometry.

A further serious drawback of the prior art warhead/projectile case creation processes is that typically warhead/projectile cases are machined or forged from solid bar stock. Consequently, as much as seventy-five percent of the high-quality steel used to manufacture a warhead/projectile case goes into the scrap bin. This results in a huge waste of energy, time and material.

Still another serious drawback of the prior art techniques is that any hole, regardless of depth, that is machined in the solid bar stock, must have a zero draft angle (straight walls). A draft angle (taper), from the bottom of the hole to the beginning of the hole, creates a variation in wall thickness which is not acceptable in the munitions industry, for example. While complex, three dimensional, nonlinear designs can be created on the inside of cases with no draft angle, a myriad of specialized tooling and hardware is required which, for all practical purposes, makes the end product prohibitively expensive.

The investment casting process, also known as the "lost-wax "casting process, provides a viable solution to many of the problems associated with traditional machining methods. Despite an industry bias against cast casings, by its very nature, the investment casting process lends itself well to the creation of protruding or indented features, such as the aforementioned notches. Another advantage is the significant reduction in material waste as well as a reduction in the time required to perform any necessary finish machining operations, since parts may be cast to near-net shape.

The first step in the traditional investment casting process is to produce a wax replica of the part to be cast. This item is commonly referred to as a wax pattern or wax mold. Typically, wax patterns are produced by injecting melted wax into an aluminum mold assembly with internal cavities and/or cores conforming to the desired was pattern shape. Upon cooling and solidifying, the wax pattern must be removed from the aluminum assembly.

For the purposes of the present invention, this is where problems with the prior art arise. A hollow wax pattern with a round cross section, such as a wax pattern for producing the aforementioned warhead/projectile casing with an internal notch configuration, can not be produced by an aluminum mold of conventional design. That is because, in order to produce the hollow, notched interior surface, the mold design would have to incorporate an aluminum core, and, in addition this core would have to have protrusions in order to create indentations (notches) in the wax pattern. This creates an interference condition in which the removal of the wax pattern from the aluminum core is impossible without destroying the wax pattern.

Thus, there is a need in the art for an inexpensive apparatus and method for creating designs on the inside and outside of cases and other objects.

SUMMARY OF TIE INVENTION

Accordingly, an apparatus for creating designs on the interior of molds includes a resilient form with an exterior and an interior, with a design formed on the exterior. A rigid support member is removably attached to the interior of the resilient form. A mold pattern, conformed to removably receive the rigid support member and the resilient form in combination, completes the basic assembly.

In one aspect of the invention, a passageway in the rigid support member is provided for introducing a gas between the rigid support member and the resilient form. In a further aspect of the invention, the design is a three dimensional design. In another aspect of the invention, a vacuum application device is provided for applying a vacuum to the resilient form. In a further aspect of the invention, the vacuum application device has a draft angle. In another aspect of the invention, the vacuum application device includes a plurality of extensions conformed to create a draft angle. In yet another aspect of the invention, the exterior of the resilient form has no draft angle and the interior has a draft angle. In another aspect of the invention, a lubricant is provided between the resilient form and the rigid support member.

In another embodiment of the invention, an apparatus for creating designs on the interior and exterior of a mold includes a first resilient form with an exterior and an interior, with a design on the interior. A rigid base is conformed to removably receive the exterior of the first resilient form. A second resilient form with an exterior and an interior, with a design on the exterior, is provided. A rigid support is removably attached to the interior of the second resilient form. The rigid base and the interior of the first resilient form is conformed to removably receive the rigid support member and the second resilient form in combination.

In another embodiment of the invention, in a process for creating an investment cast case, an apparatus for creating complex designs on the interior of the case includes a flexible sleeve with an exterior with a three dimensional design and no draft angle and an interior with a draft angle and a closed end and an open and. A support core, conformed to just receive and support the interior of the flexible sleeve from the closed end to the open end, is provided. Finally, a mold pattern is conformed to releasably receive the support core and flexible sleeve in combination.

In a further aspect of the invention, a passageway is provided in the support core conformed to introduce gas at the closed end of the flexible sleeve. In one aspect of the invention, a vacuum applicator is provided. In a further aspect of the invention, the interior has no draft angle. In another aspect of the invention, lubricant is provided between the flexible sleeve and the support core.

In another embodiment of the invention, in a process for creating investment cast cases, an apparatus for creating complex designs, including undercuts, notches, grooves, counter bores, slots, dimples and bosses, on the interior and exterior of a mold is provided.

In a further embodiment of the invention, a method of creating a design on the inside of a mold includes the steps of creating a resilient form with an exterior with a design and an interior. A rigid support member is attached to the interior of the resilient form. A mold pattern is created conformed to removably receive the resilient form and the rigid support member in combination. The resilient form and the rigid support member in combination are inserted into the mold pattern. Mold material is added to the mold pattern. Then the rigid support is removed. Finally, the resilient form is removed from the mold pattern.

In another aspect of the method, a passageway is provided in the rigid support member conformed to introduce gas between the rigid support member and the resilient form. Thereafter, gas is introduced in the passageway at the porper step to facilitate removal of the rigid support member. A further aspect of the method of this invention, includes forming the exterior with no draft angle and the interior with a draft angle. In another aspect of the method of the invention, a vacuum application device is provided and, after removing the rigid support from the old pattern, the vacuum application device is inserted within the interior of the resilient form in the mold pattern. Then, a vacuum is applied to the resilient form so as to collapse the resilient form around the vacuum application device and the vacuum application device is then removed from the mold pattern.

In still another aspect of the invention, the step of adding lubricant between the resilient form and the rigid support member is provided.

In another preferred embodiment a method of creating a design on the inside and the outside of a mold is provided.

In another preferred embodiment, a method for forming an investment cast case with a three dimensional design on the interior of the case includes the steps of creating a master pattern of the three-dimensional design in a female receiver. A male rigid support core is created with a draft angle, conformed to fit within the female receiver and including a passageway for introducing gas. The passageway is sealed with a removable pin so that the male rigid support core is a solid form. The male rigid support core is inserted into the female receiver and a flexible material forming fluid is introduced into the female receiver between the female receiver and the male rigid support core. The flexible material forming fluid is allowed to cure and create a flexible sleeve with a three dimensional design on the exterior and the interior conformed exactly to the male rigid support core. The removable pin is removed and compressed gas is blown into the passageway so that the gas is introduced between the rigid support core and the flexible sleeve. The flexible sleeve is removed from the master pattern female receiver. The male rigid support core is then inserted within the interior of the flexible sleeve and the flexible sleeve and rigid support core in combination are inserted within a mold pattern conformed to form the exterior of a case. Wax is added to the interior of the mold pattern and allowed to harden. The hardened wax and the combination of the flexible sleeve and the rigid support core are removed from the mold pattern. Compressed gas is blown into the passageway and the rigid support core is removed. The flexible sleeve is removed from the hardened wax. Finally, a case with three-dimensional designs on the inside of the case is created from the hardened wax by means of a lost wax process.

In a further aspect of the method of the invention, a vacuum applicator is provided and, after the rigid support core is removed from the hardened wax and the flexible sleeve, is inserted within the flexible sleeve. Then, a vacuum is applied to the inside of the flexible sleeve with the vacuum applicator so that the flexible sleeve is pulled away from the hardened wax and attached to the vacuum applicator. Then, the vacuum applicator, and flexible sleeve, is removed from the hardened wax. In another aspect of the invention, the vacuum applicator is formed with a draft angle.

DESCRIPTION OF THE DRAWINGS

Other objects, features, and advantages of the present invention will become more fully apparent from the following detailed description of the preferred embodiment, the appended claims and the accompanying drawings in which:

DETAILED DESCRIPTION OF THE INVENTION

Figure 1:
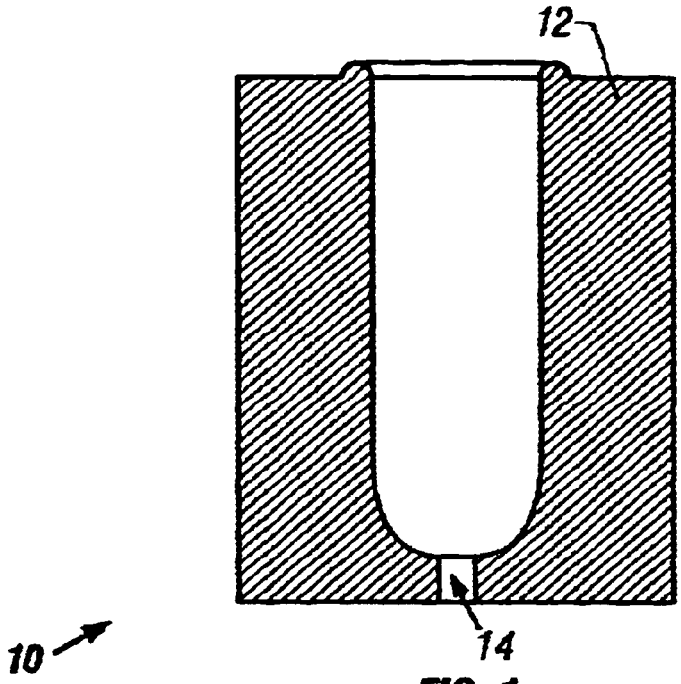
FIG. 1 is a side sectional view of the master pattern of the apparatus for creating designs on the interior of mold to the present invention.

The preferred embodiments of the present invention are illustrated by way of example in FIGS. 1 through 16. The apparatus and method for creating designs on the interior of molds 10 of the present invention may be begun to be understood by reference to FIGS. 1 and 2. FIG. 1 illustrates master pattern 12. In a preferred embodiment, master pattern 12 is formed from clear cast acrylic. The master pattern 12 is carefully created to include any and every conceivable form of three dimensional design which may be desired to be created, including but not limited to non-linear overhangs and undercuts, notches, grooves, counter bores, slots, dimples, and bosses. Master pattern 12 includes inlet 14 as will be discussed more fully hereafter.

Figure 2:
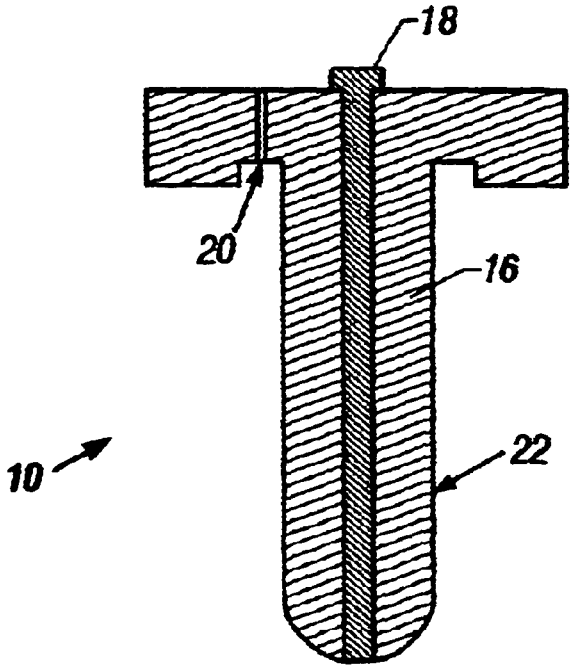
FIG. 2 is a side sectional view of the support core of the present invention.

Referring now to FIG. 2, support core 16 is illustrated. Support core 16 includes removable pin 18 and an air vent ( passageway) 20. Additionally, in a preferred embodiment, support core 16 includes a draft angle 22.

Figure 3:
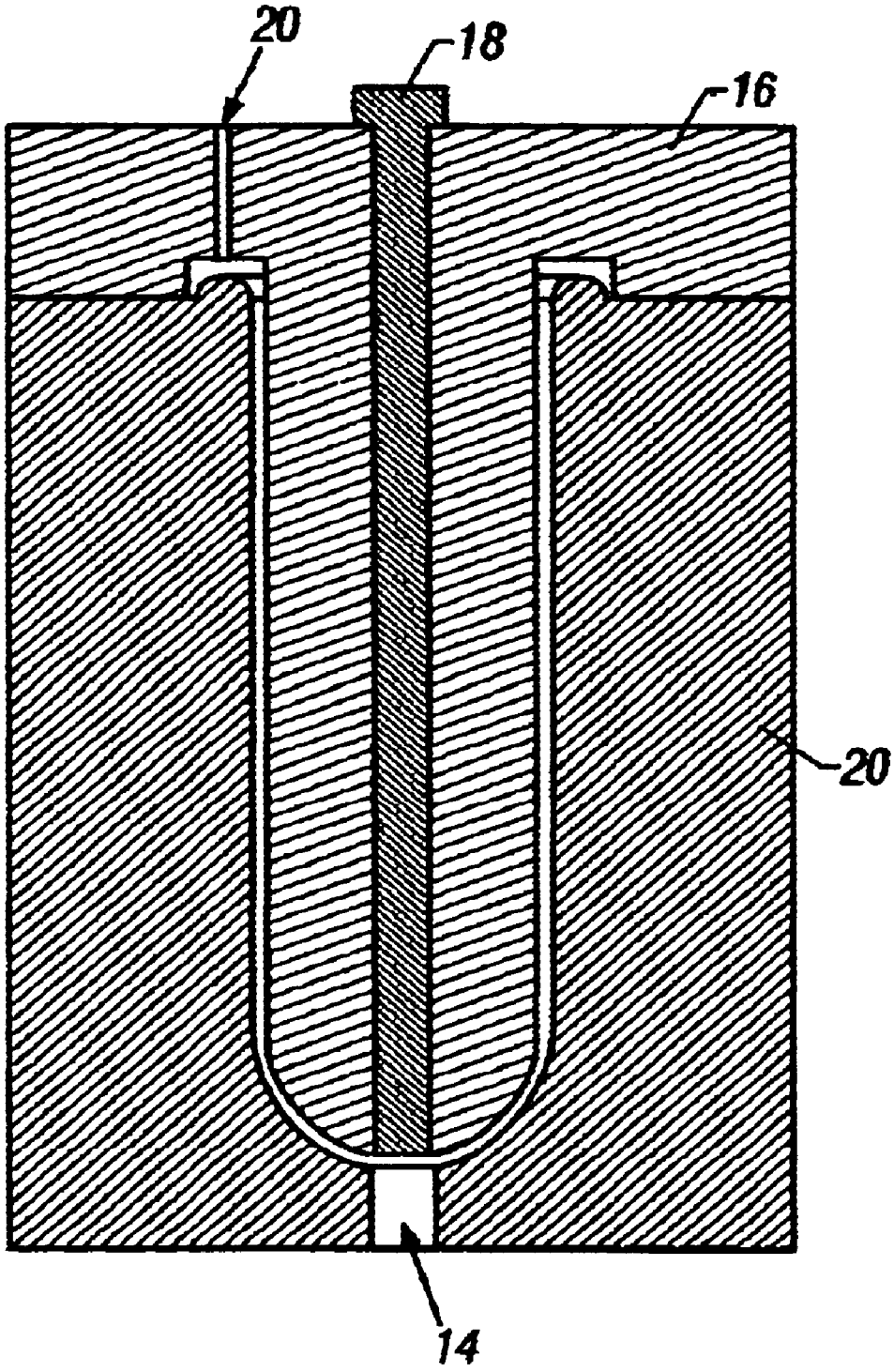
FIG. 3 is a side sectional view of the support core, with a removable pin in place, joined together with the master pattern.

FIG. 3 shows support core 16 in place within master pattern 12. Removable pin 18 is shown in place within support core 16, so that support core 16 is a solid form.

Figure 4:
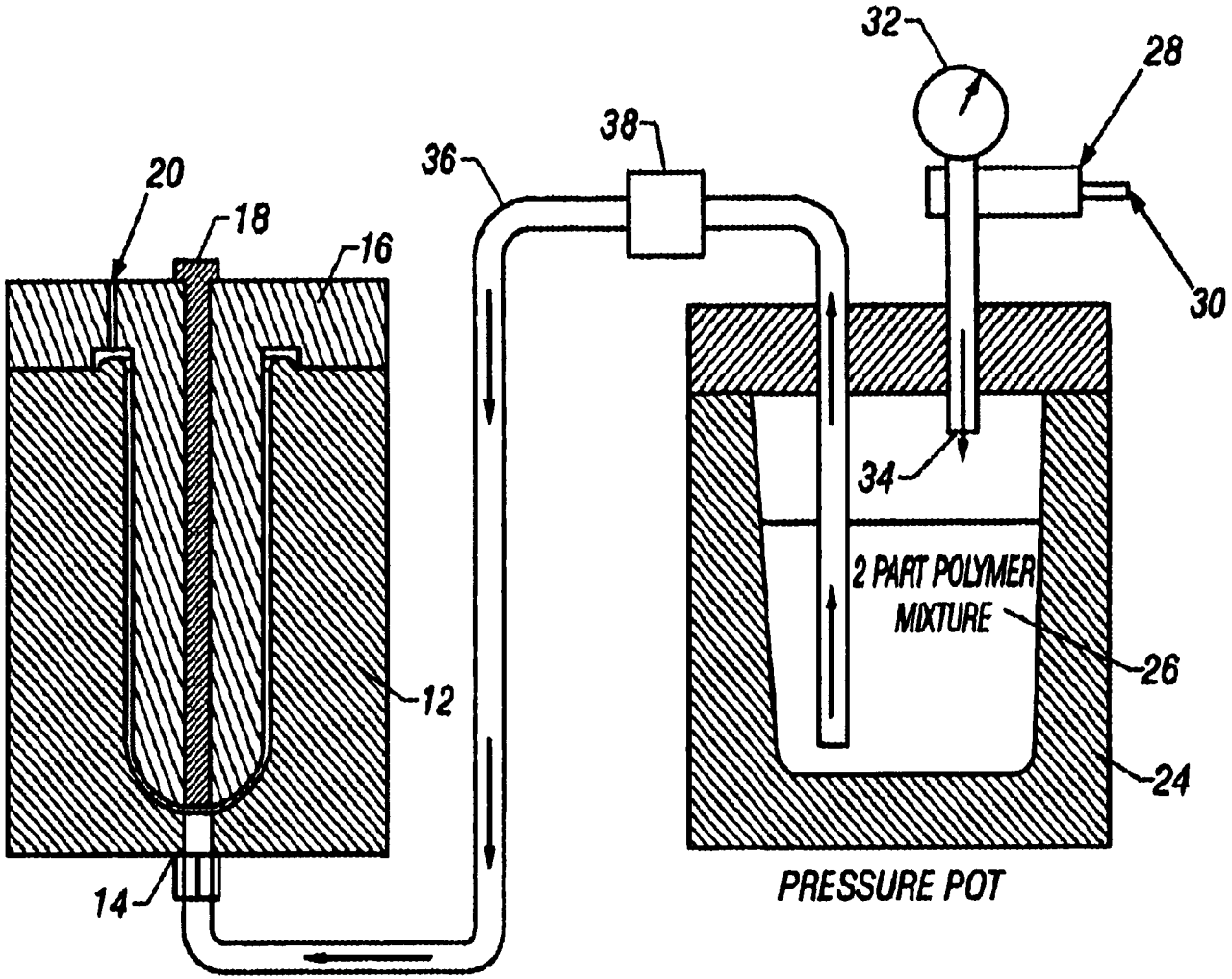
FIG. 4 is a side sectional view illustrating the formation of the flexible sleeve of the present invention by using combination illustrated in FIG. 3.

Referring now to FIG. 4, one step of the method of the invention is illustrated whereby pressure pot 24 includes flexible material forming fluid 26. Flexible material forming fluid 26 may be any liquid for forming a flexible material as is now known or hereafter developed such as a polymer of any type. As illustrated, pressure pot 24 includes a pressure system 28 including an air pressure inlet 30, pressure gauge 32 and air pressure outlet 34. Flexible material forming fluid 26 is forced from pressure of pot 24 through connection 36 controlled by open and close valve 38. Connection 36 is attached to inlet 14 on master pattern 12. As illustrated, support core 16 with removable pin 18 is in position within master pattern 12. Open and close valve 38 is opened, air pressure is applied through pressure system 28 and flexible material forming fluid 26 flows into master pattern 12 and around support core 16. Air vent 20 allows air to escape from master pattern 12.

Figures 5, 6, 7:
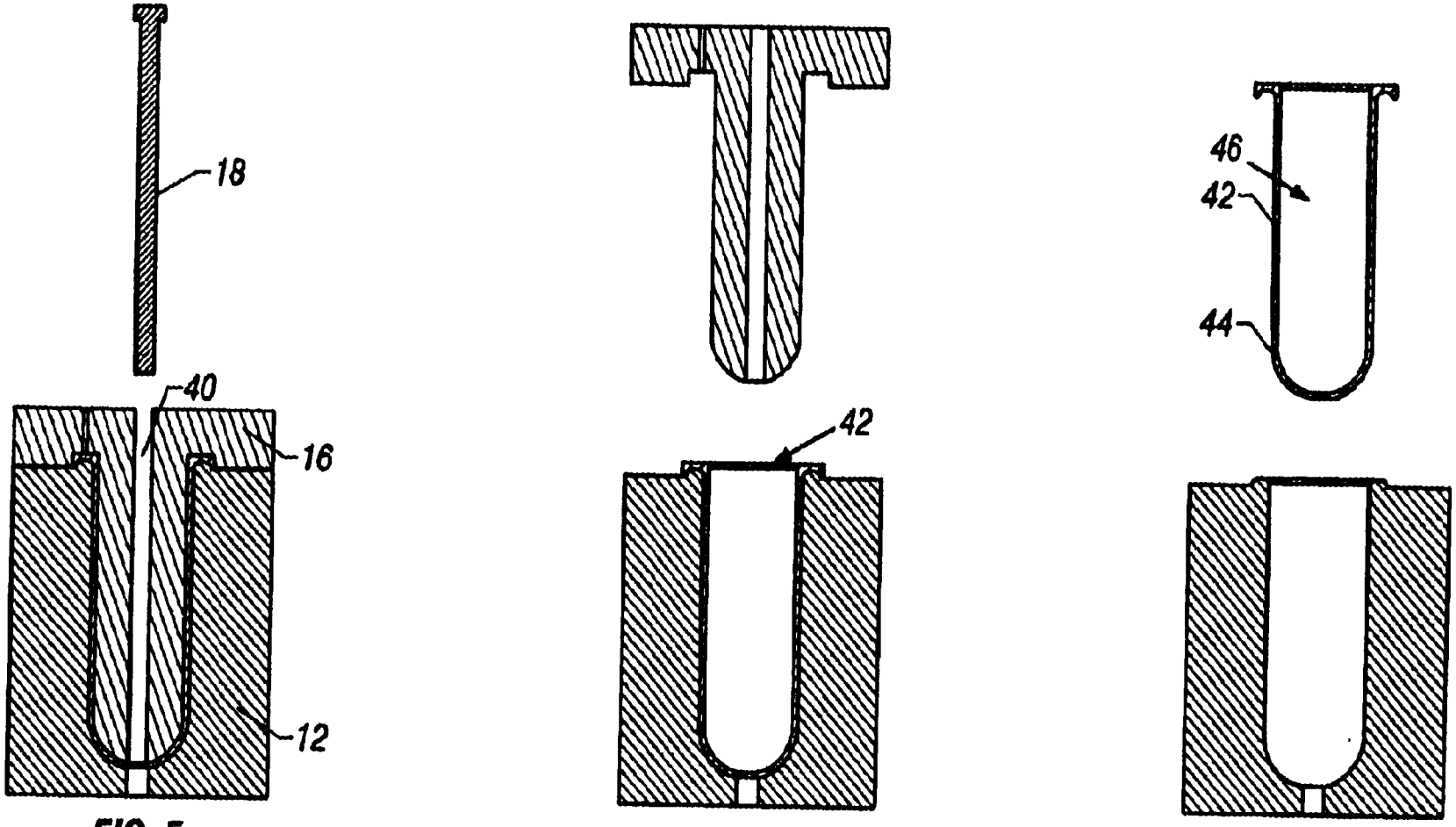
FIG. 5 shows the master pattern in combination with the support core where in the removable and is removed and the flexible sleeve has been formed.
FIG. 6 is an exploded view showing the support core separated from the flexible sleeve and removed from the master pattern.
FIG. 7 is an exploded view showing the flexible sleeve removed from the master pattern.

Referring now to FIGS. 5, 6, and 7, removable pin 18 is shown removed from support core 16 exposing pin passageway 40. If necessary, gas, compressed air or the like, is introduced into passageway 40 so that support core 16 may be removed from master pattern 12. In some cases, no air or gas is needed and passageway 40 is unnecessary. At that point, flexible sleeve 42, formed from the flexible material forming fluid 26, is removed from master pattern 12. Flexible sleeve 42 now includes an exterior that exactly matches the master pattern that was painstakingly and carefully created in the master pattern 12. The resulting three dimensional design created in flexible sleeve 42 is created on the exterior 44 of flexible sleeve 42. Additionally, because support core 16 was formed with a draft angle 22, the interior 46 of flexible sleeve 42 has an exactly identical draft angle 22. To reiterate, exterior 44 includes three dimensional designs exactly matching the designs in master pattern 12 without a draft angle while interior 46 of flexible sleeve 42, in a preferred embodiment, has a draft angle 22 identical to and formed by a draft angle 22 of support core 16.

Figure 10:
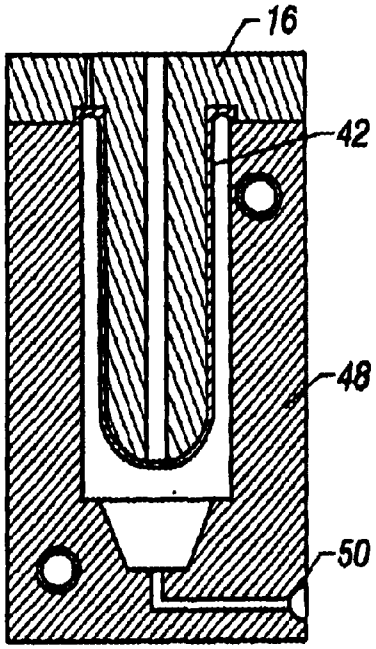
FIG. 10 shows the flexible sleeve held by the support core in place within the mold pattern.
Figure 9:
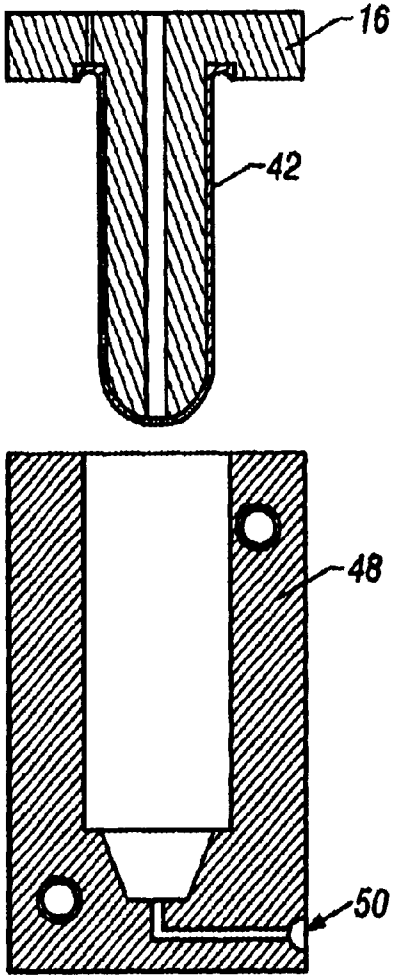
FIG. 9 is an exploded view showing the flexible sleeve in combination with the support core ready for insertion into the mold pattern.
Figure 8:
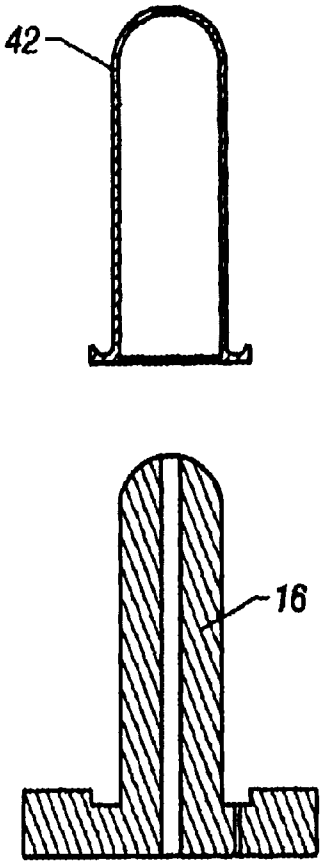
FIG. 8 is an exploded view showing the flexible sleeve in preparation for been inserted over the support core without the removable pin.

Referring now to FIGS. 8, 9, and 10, the apparatus and method for creating designs on the interior of molds is further explained. FIG. 8 shows flexible sleeve 42 in position to be reconnected, attached, to support core 16. Support core 16 at this stage does not include removable pin 18 so that pin passageway 40, if provided, is open and free. FIG. 9 shows flexible sleeve 42 in position over support core 16, i.e. with support core 16 inserted in the interior46 of flexible sleeve 42, and ready for insertion together into mold pattern 48. Mold pattern 48 is any mold pattern desired for the exterior of the final product. For example, FIG. 9 shows mold pattern 48 formed into the exterior smooth shape of a projectile case. In FIG. 10, flexible sleeve 42 in combination with support core 16 is shown in position on mold pattern 48. Mold pattern 48 includes injection port 50. It should be clear at this time, that the exterior 44 of flexible sleeve 42 which includes the three dimensional design from master pattern 12 will form the interior of the projectile case created by mold pattern 48.

Figure 11:
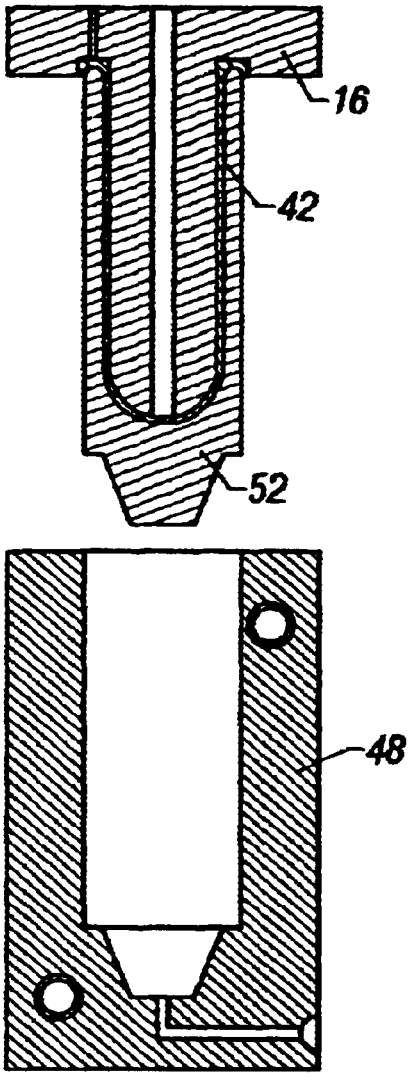
FIG. 11 is an exploded view showing the flexible sleeve and the support core removed from the mold pattern with a mold material adhered to the flexible sleeve.
Figure 12:
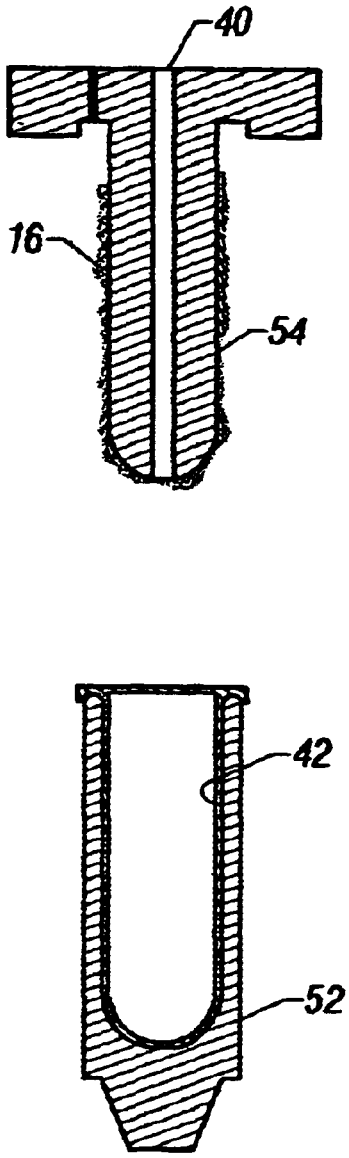
FIG. 12 is an exploded view showing the support core removed from the flexible sleeve and would be mold material still adhered to the flexible sleeve.

Referring now to FIGS. 11 and 12, mold material 52, which was injected into mold pattern 48 through injection port 50, has solidified. In FIG. 11, mold material 52, having taken on the exterior form of the projectile case created by mold pattern 48, has been removed from mold pattern 48. At this time, support core 16 and flexible sleeve 42 are still connected to mold material 52. In FIG. 12, gas, such is compressed air, for example, has been introduced into pin passageway 40 thereby separating support core 16 from flexible sleeve 42 and allowing support core 16 to be easily withdrawn from flexible sleeve 42. In a preferred embodiment, a lubricant 54 is previously added between support core 16 and flexible sleeve 42. Lubricant 54 may be any appropriate lubricant now known or hereafter developed, such as, for example, talcum powder.

Figure 13:
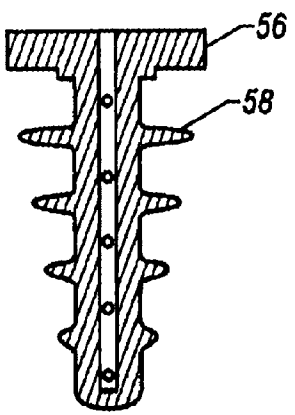
FIG. 13 is an exploded view illustrating the vacuum extractor of the present invention part to insertion within the flexible sleeve to which the mold material is still attached.
Figure 13:
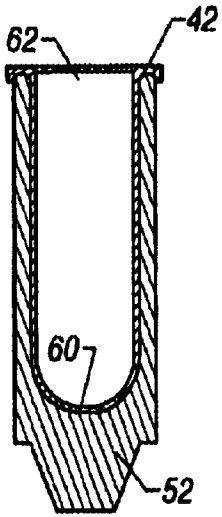
Figure 14:
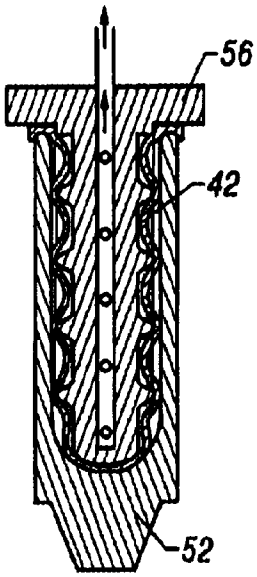
FIG. 14 illustrates the vacuum extractor in place within the mold material and the flexible sleeve as a vacuum is applied so that the flexible material is pulled away from the mold material.
Figure 15:
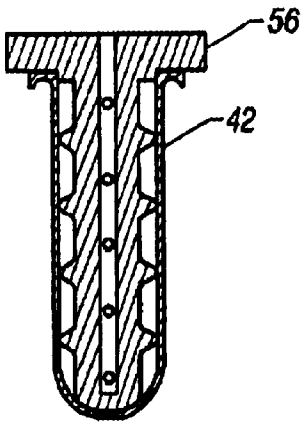
FIG. 15 is an exploded view and showing the vacuum extractor removed from the mold material along with the flexible sleeve leaving the finished mold pattern.
Figure 15:
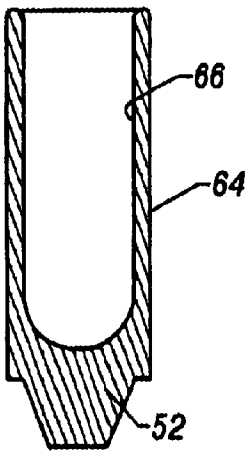

Referring now to FIGS. 13, 14, and 15, a preferred embodiment for removing flexible sleeve 42 from mold material 52 is illustrated. In many cases, flexible sleeve 42 may physically be removed from mold material 52 simply by pinching flexible sleeve 42 together and withdrawing it. However, in larger mold patterns 48, and whenever the design created in master pattern 12 is intricate and complex such that the design may be damaged when removing the flexible sleeve 42, a preferred embodiment includes withdrawing flexible sleeve 42 by means of vacuum extractor 56. In use, vacuum extractor 56 is inserted within flexible sleeve 42 while still in connection with mold material 52. As illustrated, once vacuum extractor 56 is in place within flexible sleeve 42, a vacuum is applied such that flexible sleeve 42 is sucked onto vacuum extractor .56 and away from mold material 52. At that point, vacuum extractor 56, in combination with flexible sleeve 42, is removed from mold material 52. In a preferred embodiment, vacuum extractor 56 includes a draft angle 22. In another preferred embodiment, vacuum extractor 56 includes a plurality of extensions 58 conformed to form a draft angle by decreasing dimension toward the closed end 60 of flexible sleeve 42 and increasing dimension toward the open end 62 of flexible sleeve 42.

At this time, as illustrated in FIG. 15, mold material 52 includes an exterior 64 created by mold pattern 48 and the identical design from master pattern 12 on the interior 66 of mold material 52 which exactly matches the design on the exterior 44 of flexible sleeve 42. In a preferred embodiment, mold material 52 is wax. At this time, mold material 52 is utilized to create a cast case with three dimensional designs on the inside of the case identical to the designs now on the hardened wax mold material 52 by means of a lost wax process as is known in the art and not disclosed more fully herein.

Figure 16:
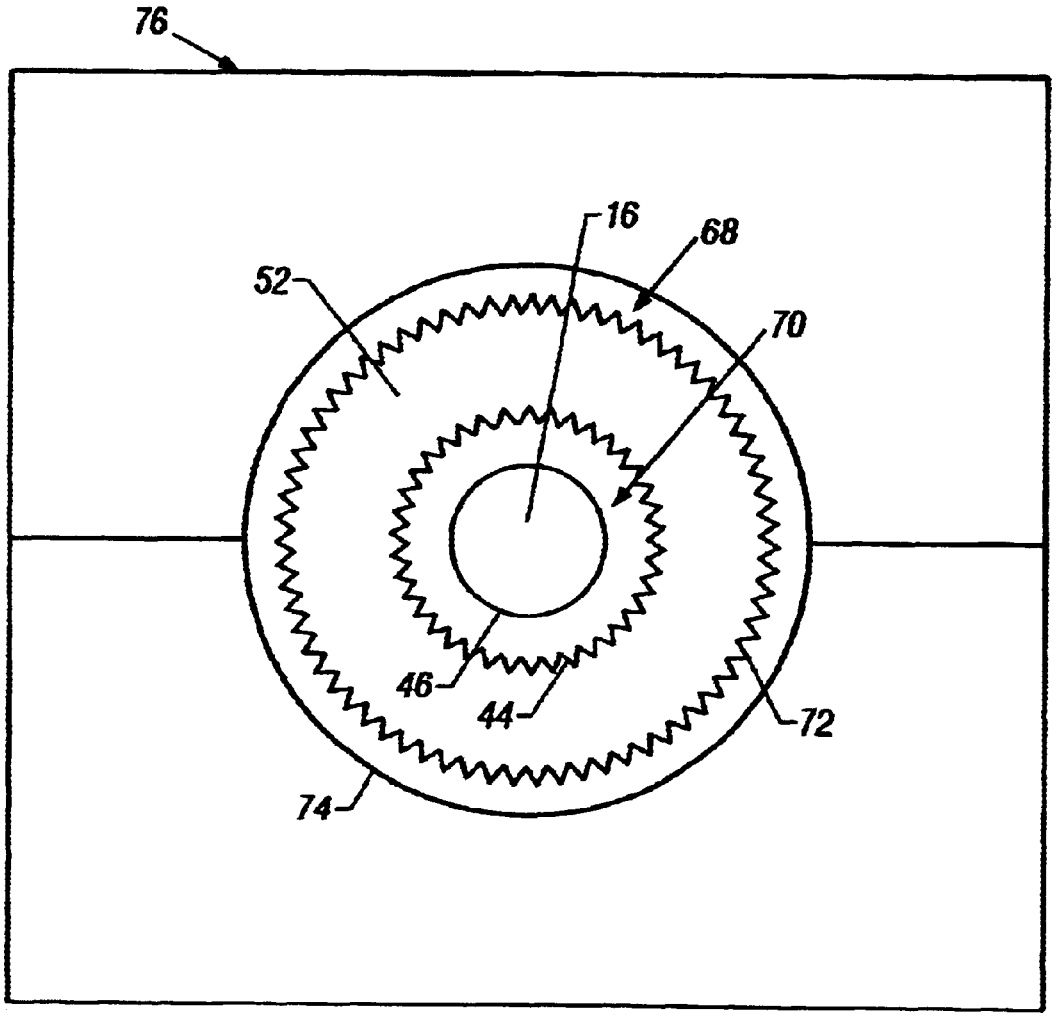
FIG. 16 is a top sectional view of the apparatus of the invention for creating designs on the interior and the exterior of a mold.

Applicant' invention further includes an apparatus and method for creating complex designs on the interior and exterior of a mold. By way of example and not limitation, it is sometimes desirable for notches and the like to be formed on both the inside and outside of a projectile case. Whenever necessary this is easily accomplished by Applicants' invention as illustrated in FIG. 16. To begin with, a master pattern is created with the required design on the outside of master pattern 12. A first flexible sleeve 68 is formed in a manner as described above for the creation of flexible sleeve 42, except that the design is created on the interior 72 of first flexible sleeve 68 not the exterior 74. Thereafter, a second flexible sleeve 70 is created in the identical manner as flexible sleeve 42 discussed above, including having the design on the exterior 44 and not the interior. Once both first flexible sleeve 68 and second flexible sleeve 70 are ready, first flexible sleeve 68 is inserted in and contained and supported by rigid base 76. At that point, second flexible sleeve 70 in combination with support core 16, as discussed and disclosed above, is positioned within the interior 72 of first flexible sleeve 68 and spaced apart therefrom. At that point, mold material 52 is injected between the interior 72 of first flexible sleeve 68 and the exterior 44 of second flexible sleeve 70. Because the desired design is on the interior 72 and on the exterior 44, the mold material 52 has the desired design both on the exterior 64 and the interior 66. Once mold material 52 has hardened, rigid base 76 is removed and first flexible sleeve 68 is peeled or rolled off of the exterior 64. Next, support core 16 is removed and then second flexible sleeve 70 is removed leaving a wax, for example, mold of mold material 52 with complex designs on both the exterior 64 and the interior 66. Thereafter, a casing with identical features can be created by the lost wax process.

By way of the present invention then, any form of complex design is capable of being created on the interior 66 or exterior 64 of mold material 52. Importantly, because flexible sleeve 42, used to create the design on the interior 66 of mold material 52 has an exterior 64 that has no draft angle, the interior 66 of mold material 52 also has no draft angle. Once again, this is critical, because in many instances, draft angles on the interior result in inferior products. By way of example, as previously discussed warhead and projectile cases require uniform thicknesses for predictable results. Prior to applicants' invention, tedious and expensive hand tooling was the only way complex designs could be created on the interior of projectile cases. Now, by way of applicant' invention, extraordinarily complex designs are capable of being formed on the interior and the exterior of projectile cases by investment casting. Huge amounts of material waste are prevented and time saved with a product that is superior in strength and fragmentation predictability.

While the present invention has been disclosed by way of example in connection with use in the creation of investment casting warhead and projectile cases, certainly no narrow limitation may be inferred thereby on the uses of applicant' invention. For any business, and for any purpose, where a need exists for the creation of a complex design on the interior and/or the interior and exterior of an object, applicant' invention applies. That is, the description of the present embodiments of the invention have been presented for purposes of illustration, but are not intended to be exhaustive or. to limit the invention to the form disclosed. Many modifications and variations will be apparent to those of ordinary skill in the art. As such, while the present invention has been disclosed in connection with the preferred embodiment thereof, it should be understood that there may be other embodiments with fall within the spirit and scope of the invention as defined by the following claims.

What is claimed is:

1. An apparatus for creating designs on an interior of a mold, the apparatus comprising:

a) a resilient form with an exterior and an interior, with a design formed on the exterior wherein said exterior has no draft angle and said interior has a draft angle;

b) a rigid support member removably attached to the interior of said resilient form; and c) a mold pattern conformed to removably receive said rigid support member and said resilient form in combination.

2. The apparatus of claim 1 further comprising a passageway in said rigid support member for introducing a gas between said rigid support member and said resilient form.

3. The apparatus of claim 1 wherein said design is a three dimensional design.

4. The apparatus of claim 1 further comprising a vacuum application means for applying a vacuum to said resilient form.

5. The apparatus of claim 4 wherein said vacuum application means has a draft angle.

6. The apparatus of claim 4 wherein said vacuum application means further comprises a plurality of extensions conformed to create a draft angle.

7. The apparatus of claim 1 further comprising a lubricant between said resilient form and said rigid support member.

8. An apparatus for creating designs on the interior and exterior of a mold, the apparatus comprising:

a) a first resilient form with an exterior and an interior, with a design on said interior;

b) a rigid base conformed to removably receive the exterior of said first resilient form;

c) a second resilient form with an exterior and an interior, with a design on said exterior;

d) a rigid support member removably attached to the interior of said second resilient form; and e) said rigid base and said interior of said first resilient form conformed to removably receive said rigid support member and said second resilient form in combination.

9. The apparatus of claim 8 wherein said interior of said first resilient form and said exterior of said second resilient form have no draft angle.

10. An apparatus for creating complex designs on an interior of investment cast cases, the apparatus comprising:

a) a flexible sleeve with an exterior with a three dimensional design and no draft angle and an interior with a draft angle and a closed end and an open end;

b) a support core conformed to just receive and support the interior of the flexible sleeve from the closed end to the open end; and c) a mold pattern conformed to releasably receive the support core and flexible sleeve in combination.

11. The apparatus of claim 10 further comprising a passageway in the support core conformed to introduce gas at the closed end of the flexible sleeve.

12. The apparatus of claim further comprising a vacuum applicator.

13. The apparatus of claim 10 wherein said interior has no draft angle.

14. The apparatus of claim 10 further comprising lubricant between the flexible sleeve and the support core.

15. An apparatus for creating complex designs, including undercuts, notches, grooves, counter bores, slots, dimples and bosses, on an interior and an exterior of a mold, the apparatus comprising:

a) a first flexible sleeve with an exterior with a draft angle and an interior with a complex design and no draft angle and a closed end and an open end;

b) a rigid base conformed to removably receive the exterior of said first flexible sleeve;

c) a second flexible sleeve with an exterior with a complex design and no draft angle and an interior with a draft angle and a closed end and an open end;

d) a support core conformed to just receive and support the interior of the second flexible sleeve from the closed end to the open end; and e) said first flexible sleeve conformed to removably receive said support core and said second flexible sleeve in combination.

16. A method of creating a design on the inside of a mold, the method comprising the steps of:

a) creating a resilient form with an exterior with a design and an interior, wherein said exterior has no draft angle and said interior has a draft angle;

b) attaching a rigid support member to the interior of said resilient form;

c) creating a mold pattern conformed to removably receive said resilient form and said rigid support member in combination;

d) inserting said resilient form and said rigid support member in combination in said mold pattern;

e) adding mold material to said mold pattern;

f) removing said rigid support; and g) removing said resilient form from said mold pattern.

17. The method of claim 16 further comprising the steps of:

a) providing a passageway in said rigid support member conformed to introdu gas between said rigid support member and said resilient form; and b) after step e) introducing gas in said passageway.

18. The method of claim 16 further comprising the steps of:

a) providing a vacuum application means;

b) after step f) inserting said vacuum application means within said interior of said resilient form in said mold pattern;

c) applying a vacuum to said resilient form so as to collapse said resilient form around said vacuum application means; and d) removing said vacuum application means and said resilient form from said mold pattern.

19. The method of claim 16 further comprising the step of adding lubricant between said resilient form and said rigid support member.

20. A method of creating a design on the inside and outside of a mold, the method comprising the steps of:

a) creating a first resilient form with an exterior and an interior, with a design on the interior;

b) holding the exterior of said first resilient form within a rigid base;

c) creating a second resilient form with an exterior with a design and an interior;

d) attaching a rigid support member to the interior of said second resilient form;

e) inserting said second resilient form and said rigid support member in combination within the interior of said first resilient form;

f) adding mold material between the interior of said first resilient form and the exterior of said second resilient form;

g) removing the rigid base from the first resilient form;

h) removing the first resilient form from the mold material;

i) removing the rigid support member from the second resilient form; and j) removing said second resilient form from the mold pattern.

21. A method for forming an investment cast case with a three dimensional design on the interior of the case, the method comprising the steps of:

a) creating a master pattern of the three dimensional design in a female receiver;

b) creating a male rigid support core with a draft angle, conformed to fit within the female receiver and including a passageway for introducing gas;

c) sealing the passageway with a removable pin so that the male rigid support core is a solid form;

d) inserting the male rigid support core into the female receiver and introducing a flexible material forming fluid into the female receiver between the female receiver and the male rigid support core;

e) allowing the flexible material forming fluid to cure and create a flexible sleeve with a three dimensional design on an exterior and an interior conformed exactly to the male rigid support core;

f) removing the removable pin and blowing compressed gas into the passageway so that gas is introduced between the rigid support core and the flexible sleeve;

g) removing the flexible sleeve from the master pattern female receiver;

h) inserting the male rigid support core within the interior of the flexible sleeve;

i) inserting the flexible sleeve and rigid support core in combination within a mold pattern conformed to form the exterior of a case;

j) adding wax to the interior of the mold pattern and allowing the wax to harden;

k) removing the hardened wax and the combination of the flexible sleeve and the rigid support core from the mold pattern;

l) introducing gas into the passageway and removing the rigid support core;

m) removing the flexible sleeve from the hardened wax; and n) creating a case with three dimensional designs on the inside of the case from the hardened wax by means of a lost wax process.

22. The method of claim 21 further comprising the steps of:

a) creating a vacuum applicator;

b) after step 1) inserting the vacuum applicator within the flexible sleeve;

c) applying a vacuum to the inside of the flexible sleeve with the vacuum applicator so that the flexible sleeve is pulled away from the hardened wax; and d) removing the vacuum applicator in combination with the flexible sleeve from the hardened wax.

23. The method of claim 22 further comprising the step of forming the vacuum applicator with a draft angle.

24. An apparatus for creating designs on an interior of a mold, the apparatus comprising:

a) a resilient form with an exterior and an interior, with a design formed on the exterior;

b) a rigid support member removably attached to the interior of said resilient form;

c) a mold pattern conformed to removably receive said rigid support member and said resilient form in combination; and d) a vacuum application means for applying a vacuum to said resilient form wherein said vacuum application means further comprises a plurality of extensions conformed to create a draft angle.

25. An apparatus for creating complex designs on an interior of an investment cast case, the apparatus comprising:

a) a flexible sleeve with an exterior with a three dimensional design and no draft angle and an interior with a draft angle and a closed end and an open end;

b) a support core conformed to just receive and support the interior of the flexible sleeve from the closed end to the open end;

c) a mold pattern conformed to releasably receive the support core and flexible sleeve in combination; and d) a passageway in the support core conformed to introduce gas at the closed end of the flexible sleeve.

* * * * *

UNITED STATES PATENT AND TRADEMARK OFFICE

CERTIFICATE OF CORRECTION

PATENT NO. : 6,634,410 B1 
DATED : October 21, 2003
INVENTOR(S) : Wilson, John H., Wilson, Robert E. and Wilson, John T.

It is certified that error appears in the above-identified patent and that said Letters Patent is hereby corrected as shown below:

Column 2,
Line 34, “was” should read -- wax --.

Column 3,
Line 25, “and” should read -- end --.
Line 59, “porper” should read -- proper --.

Column 4,
Line 58, “to” should read -- of --.

Column 5,
Line 2, “and” should read -- end --.
Line 10, “been” should read -- being --.

Column 6,
Line 57, “is” should read -- as --.

Column 7,
Line 34, “Applicant” should read -- Applicants’ --.

Column 8,
Line 17, “applicant” should read -- applicants’ --.

Column 9,
Line 59, “introdu” should read -- introduce --.

Signed and Sealed this

Sixth Day of July, 2004

JON W. DUDAS
*Acting Director of the United States Patent and Trademark Office*